US005121284A

United States Patent [19]

Onodera et al.

[11] Patent Number: 5,121,284

[45] Date of Patent: Jun. 9, 1992

[54] DRIVER CIRCUIT WITH FEEDBACK FOR LIMITING UNDERSHOOT/OVERSHOOT AND METHOD

[75] Inventors: Keith K. Onodera, San Jose; Shu-ing Ju, Sunnyvale, both of Calif.

[73] Assignee: National Semiconductor Corporation, Santa Clara, Calif.

[21] Appl. No.: 574,199

[22] Filed: Aug. 27, 1990

[51] Int. Cl.[5] ..... H01H 47/00

[52] U.S. Cl. ..... 361/152; 379/331; 379/412

[58] Field of Search ..... 361/143, 152, 154, 160, 361/170, 187, 195, 196; 379/331, 412

[56] References Cited

U.S. PATENT DOCUMENTS

| | | | |
|---|---|---|---|
| 4,680,667 | 7/1987 | Petrie | 361/154 |
| 4,737,882 | 4/1988 | D'Onofrio | 361/154 |
| 4,764,840 | 8/1988 | Petrie et al. | 361/154 |
| 4,845,420 | 7/1989 | Oshizawa et al. | 361/152 |

*Primary Examiner*—A. D. Pellinen
*Assistant Examiner*—J. Gaffin
*Attorney, Agent, or Firm*—Limbach & Limbach

[57] ABSTRACT

A drive circuit suitable for driving an inductive load such as an isolation transformer is disclosed having a driver stage and associated feedback circuitry. The driver stage has at least one output for connecting to the load and is switchable between a drive mode and an idle mode of operation. In the drive mode of operation, the driver stage produces a data output signal at the output which corresponds to a data input signal received by the driver stage. In the idle mode, the driver stage produces an idle signal, in response to a control signal, which functions to discharge the conductive load. The feedback circuit produces the control signal in response to the idle signal and adjusts the control signal so that the idle output signal will approach a predetermined neutral level. The inductor will proceed to discharge and, once discharged, will shift the idle voltage. The shift in voltage will cause the feedback action to terminte, thereby preventing the feedback action from introducing charging current into the inductor which would adversely effect the transmission of further data.

18 Claims, 8 Drawing Sheets

DRIVER CIRCUIT WITH FEEDBACK FOR LIMITING UNDERSHOOT/OVERSHOOT AND METHOD

TECHNICAL FIELD

The present invention relates generally to data communications and more particularly to a driver circuit for use in local area networks and the like having feedback circuitry for limiting undershoot and overshoot resulting from an inductive load.

BACKGROUND OF THE INVENTION

In data communication applications, it is frequently necessary to transmit data to inductive loads. For example, data transceivers used in local area networks (LANs) include data driver circuits having outputs which are connected to an isolation transformer. Such isolation transformers present an inductive load which causes the output of the driver to either undershoot or overshoot. Standards have been developed, such as in Ethernet applications, which specify the maximum amount of permissible overshoot and undershoot.

Attempts have been made to develop data driver circuits which comply with the undershoot/overshoot specifications, but which are also capable of rapidly discharging the inductive load. Referring to the drawings, FIG. 1 shows a conventional driver circuit of the type used in Ethernet LAN applications.

The conventional driver circuit 10 includes an output drive stage 18 having a pair of data inputs on lines 24 and 28 which receive data input signals RXOP and RXON, respectively. The driver stage includes a differential amplifier input comprised of transistors $Q_5$ and $Q_6$ having resistive loads $R_3$ and $R_4$. The output of the differential amplifier drives a pair of emitter-follower configured transistors $Q_9$ and $Q_{10}$.

The differential output of the drive stage is at the emitters of transistors $Q_9$ and $Q_{10}$ which are connected to lines 32 and 34, respectively. The output lines are coupled to the primary winding of an isolation transformer (not depicted) having a resistor connected in parallel. The transformer and parallel resistor equivalent circuit 20 is represented by inductor L and resistor $R_L$. The differential output signals are RXP and RXN.

When a data packet is transmitted to the transceiver, driver circuit 10 in the transceiver receives the data packet on inputs 24 and 28 as signals RXOP and RXON. The data packet is retransmitted by the driver circuit and appears at lines 32 and 34 as output signals RXP and RXN.

For LAN protocols such as Ethernet, an idle period is required between transmission of data packets. During the idle period, inputs RXON and RXOP, and thus outputs RXP and RXN, are initially held at their respective maximum values. Outputs RXP and RXN must be maintained at these values for a predetermined time period referred to as the high time $t_{high}$. Period $t_{high}$ must be at least 200 nanoseconds and no longer than 8 microseconds. Ideally, the inductive load is discharged by the end of the idle period.

The driver circuit is forced to the idle mode by an enable signal coupled to line 26. The enable signal is generated by a receive squelch circuit (not depicted) which senses the presence of a data packet. The enable signal is caused to go high (a logic "1") when a data packet is being received and is caused to go low (a logic "Ø") when a data packet terminates. The idle period commences when the enable signal goes low.

The conventional driver circuit includes a switch circuit 12 which receives the enable signal on line 26 and an associated time delay circuit 14 which determines the duration of the high time $t_{high}$. Switch circuit 12 includes a differential comparator circuit made up of transistors $Q_2$ and $Q_3$, with transistor $Q_2$ biased by a pair of resistors $R_6$ and $R_5$ connected between the supply voltage and ground. The enable signal is coupled to the base of transistor $Q_3$ such that $Q_3$ is conductive when the enable signal is high (a data packet is being received) and non-conductive when the enable signal is low.

Time delay circuit 14 includes a resistor $R_1$ and capacitor C connected in parallel between the positive supply voltage and the collector of transistor $Q_3$. The RC time constant of $R_1$ and C will provide a time delay as will be described.

The collector of transistor $Q_3$ is also coupled to the base of a transistor $Q_4$ which, in turn, drives the bases of a pair of transistors $Q_7$ and $Q_8$. The collectors of transistors $Q_7$ and $Q_8$ are connected to the collectors of transistors $Q_5$ and $Q_6$, respectively, and the emitters of the four transistors are connected in common.

The operation of the conventional drive circuit will be described in connection with FIG. 1 and the timing diagram of FIG. 2. The top waveform represents the enable signal and the next waveform represents a mode control signal present at node 33 of FIG. 1. The lower waveforms represent the differential data outputs RXP and RXN driving the inductive load.

When a data packet is being received, the enable signal is caused to go high as shown at point A. The high enable signal will turn on transistor $Q_3$ and cause the collector of $Q_3$ to drop, thereby charging capacitor C of the time delay circuit. The low $Q_3$ collector voltage will also turn off transistors $Q_4$, $Q_7$ and $Q_8$.

When transistors $Q_7$ and $Q_8$ are off, the output driver stage 18 is free to retransmit the received data packet to lines 32 and 34 as can be seen by waveforms RXP and RXN of FIG. 1. The typical data modulation scheme prescribes that a data transition, occur at every bit, therefore the output signal has substantially no D.C. component which would tend to charge the inductive load. At the end of the data packet, the receive squelch detects the absence of data and causes the enable signal to go low at point B. As a result, $Q_3$ is turned off. This is the beginning of the high time period $t_{high}$.

Capacitor C will then proceed to discharge through resistor R1. The collector of transistor $Q_3$ will slowly rise, thereby causing the emitter of transistor $Q_4$ to rise. This will cause the mode control signal at node 33 to increase as can be seen by the FIG. 2 waveform.

At the same time the enable signal goes low, the source (not depicted) of input data RXOP and RXON on lines 24 and 28 will force the input data to remain at their respective maximum values. This will cause the output data signals RXP and RXN to remain at their respective maximum values as shown in FIG. 2. During this specified high period $t_{high}$, the data output signals have a substantial D.C. component which charges the inductive load L.

Eventually, the mode control voltage at node 33 will have increased sufficiently to turn on transistors $Q_7$ and $Q_8$. Transistors $Q_7$ and $Q_8$ will then draw current from load resistors R3 and $R_4$ thereby reducing the differential output signals RXP and RXN as shown at point C. This is the end of the high time period $t_{high}$.

It is desireable that the outputs RXP and RXN both approach the midlevel value and remain there throughout the idle period while the inductor L discharges. However, because of the presence of the load inductor L, there will be a tendency for the positive signal RXP to undershoot and the negative signal RXN to overshoot as shown in FIG. 2 at point D by a very substantial amount. The amount of undershoot/overshoot can be reduced by reducing the high time period $t_{high}$, but the period must be at least as long as the specified minimum period.

One conventional approach to reducing undershoot/overshoot is to employ a continuously active feedback circuit which monitors the data output signals and limits the amount of overshoot/undershoot. However, once the inductive load becomes substantially discharged, the load appears as a D.C. short circuit. The continuously active feedback circuit will attempt to force the output voltage to some minimum value which is determined by various factors including the inherent offset voltages which are present in any feedback system. This minimum value will invariably differ from the actual voltage across the discharged inductor. The feedback network will attempt to force the inductor voltage to the offset voltage thereby introducing large currents into the inductor. These currents will leave the isolation transformer inductance partially charged, thereby adversely affecting the operation of the transformer when the next data packet is received.

The present invention overcomes the above-noted shortcomings of prior art drive circuits. The magnitude of the overshoot/undershoot can be positively maintained within stringent specifications, yet the inductive load will be allowed to quickly discharge before receipt of the next data packet. These and other advantages of the present invention will become apparent to those skilled in the art upon a reading of the following Detailed Description of the Invention together with the drawings.

SUMMARY OF THE INVENTION

A drive circuit for driving an inductive load, such as the primary winding of an isolation transformer, is disclosed. The drive circuit includes driver stage means having at least one output for coupling to the load. The output may be either single-ended or differential.

The driver stage means is switchable between a drive mode and an idle mode. When in the drive mode, a data output signal is produced at the output which is responsive to a data input signal. In the idle mode, the driver stage means produces an idle output signal at the output which is responsive to a control signal.

The drive circuit further includes feedback means for generating the control signal in response to the idle output signal and for adjusting the control signal so as to cause the idle output signal to approach a predetermined neutral level by way of feedback action. During this period, the overshoot/undershoot of the idle output signal is limited and the inductive load is permitted to discharge.

The feedback means further functions to terminate the feedback action while the driver stage is in the idle mode, after the idle output signal has reached the neutral level. This occurs, for example, when the inductive load is substantially discharged and becomes a D.C. short circuit at which time the feedback action is terminated, thereby preventing the driver stage from introducing current into the discharged inductive load.

DETAILED DESCRIPTION OF THE INVENTION

Figure 3:
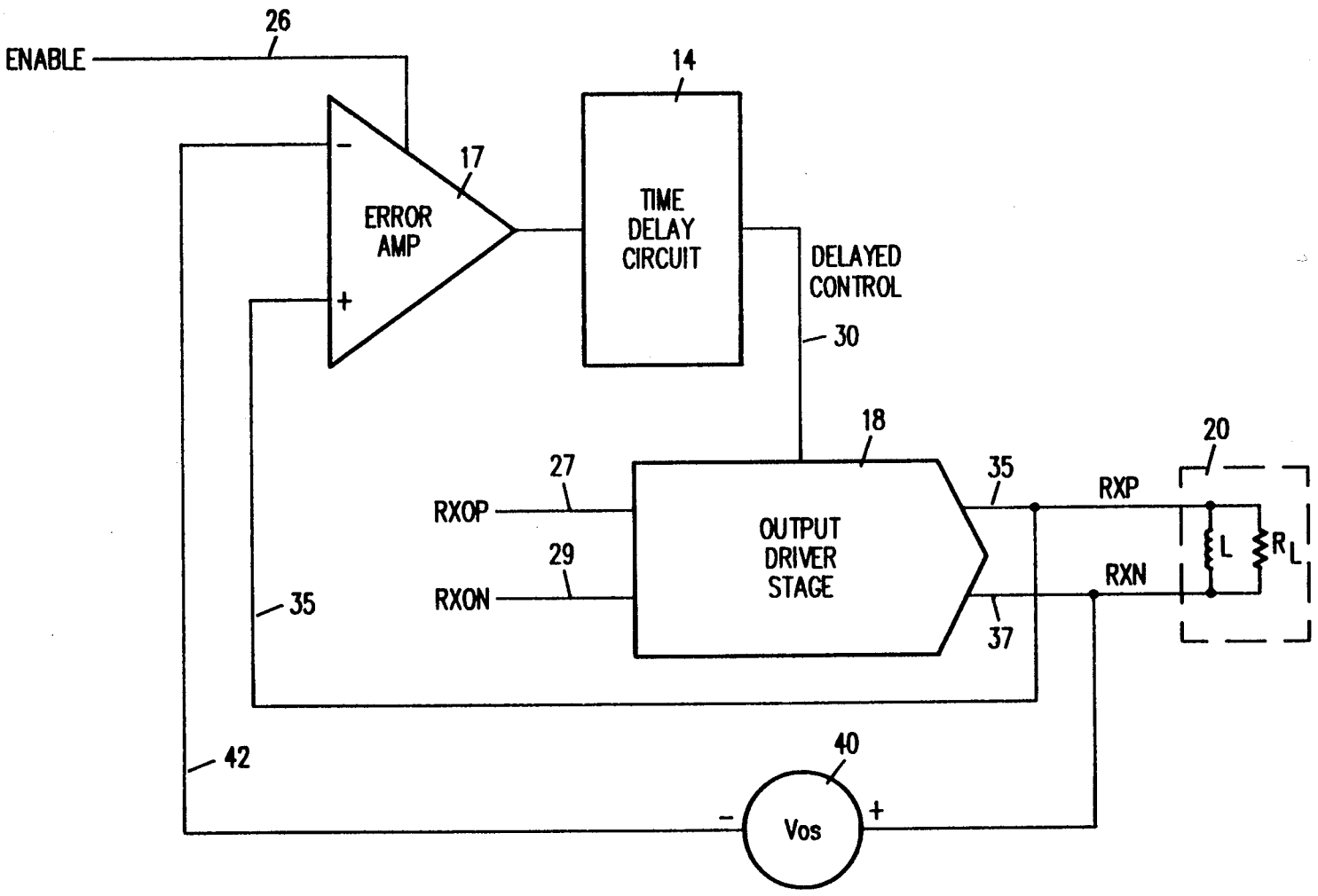
FIG. 3 is a block diagram of one embodiment of the invention which utilizes differential input and output signals.

Referring again to the drawings, a first embodiment drive circuit is depicted in FIG. 3. The drive circuit receives differential input signals RXOP and RXON on lines 27 and 29 which provides corresponding differential output signals RXP and RXN. The drive circuit includes an output driver stage 18 connected to an inductive load, such as the primary winding of an isolation transformer, represented by an equivalent circuit 20. A resistor is connected in parallel with the primary winding. The equivalent circuit includes an inductor L and parallel resistor $R_L$.

The output data signal RXP on line 35 is fed back to the non-inverting input of an error amplifier 17. Output data signal RXN on line 37 is also fed back to the error amplifier after having been summed with an offset voltage produced by an offset voltage generator 40. Line 37 is connected to the positive terminal of generator 40, with the negative terminal of the generator being connected to the inverting input of error amplifier 17 by way of line 42.

The error amplifier 17 receives an enable signal on line 26 which is produced by a receive squelch circuit (not depicted). The output of the error amplifier 17 controls a time delay circuit 14 which forwards a delayed control signal on line 30 to the output driver stage 18.

Operation of the first embodiment driver circuit will now be described in connection with FIG. 3 and the timing diagram of FIG. 4. When differential input data RXOP and RXON are being received, the receive squelch (not depicted) will cause the enable signal to go high thereby overriding the operation of error amplifier 17. This occurs at time A in FIG. 5. Circuitry not shown will reset the time delay circuit thereby causing the delay control signal on line 30 to drop in magnitude.

The low magnitude delayed control signal will not affect the operation of the output driver stage 18 so that the input data RXOP and RXON will be retransmitted as output data RXP and RXN. The FIG. 4 timing diagram shows an output data differential signal which represents the voltage difference between output signals RXP and RXN.

When the input data (data packet) terminates at time B, the receive squelch causes the enable signal to go low. The low enable signal removes the override from error amplifier 17, thereby rendering the error amplifier operational. When the override is removed, amplifier 17 also actuates the time delay circuit 14 which causes the delayed control signal on line 30 to increase in magnitude in accordance with an RC time constant.

Also at time B, it can be seen that the input data RXOP and RXON are forced by circuitry not shown to go to their respective maximum values. This causes the output data differential signal (the difference between RXP and RXN) to go to a maximum value. Thus, signal RXOP (FIG. 3) goes to the maximum high value and signal RXON goes to the maximum low value. This is the beginning of the high time period $t_{high}$.

The delayed control signal continues to increase in magnitude until it reaches a predetermined threshold voltage at time C. The time period from point B to point C is the high time period $t_{high}$ which must fall within a specified minimum and maximum values, as previously explained.

During period $t_{high}$, the polarity and magnitude of the differential feedback signal applied to the inputs of error amplifier 17 is such that the noninverting amplifier input on line 35 exceeds the inverting input on line 42 by a considerable amount. Amplifier 17 and time delay circuit 14 are implemented so that the differential feedback signal magnitude at this time will not affect the increase in the delayed control signal. Accordingly, the control signal will continue to increase as shown in the FIG. 4 timing diagram.

At time C, the delayed control signal will reach a predetermined threshold voltage. At this point, the control signal will start to disable the output of the output driver stage 18 by forcing positive output signal RXP to drop and negative output signal RXN to increase. This will cause, by definition, the output data differential signal to drop in magnitude as inductor L proceeds to discharge. This action also causes the differential feedback signal, the difference in magnitude between the voltages applied to the error amplifier inputs, to also decrease.

The magnitude of the output data differential signal will decrease to zero volts and then change from a positive to a negative polarity. The change in polarity indicates that the negative going output signal RXP has proceeded to slightly undershoot the midlevel signal point and the positive going output signal RXN has proceeded to slightly overshoot the midlevel point.

At time D, the magnitude of the negative polarity output data differential signal is equal to the offset voltage $V_{OS}$ produced by generator 40. The differential feedback signal applied to the error amplifier 17 is at substantially zero volts at this point. Error amplifier 17 will then proceed to operate in a linear mode and provide negative feedback so as to limit any further increase in the magnitude of the delayed control signal. The negative feedback action will hold the differential output of the output driver stage at the offset voltage, sometimes referred to as the neutral level, while the inductor L has an opportunity to further discharge.

Once the inductor has discharged, it will appear as an effective D.C. short circuit. This will cause the output data differential signal to approach the zero volt level as shown at point E. This will also cause the differential feedback signal to depart from zero volts and approach the offset voltage $V_{OS}$ produced by generator 40. The error amplifier 17 will switch back to a nonlinear mode and will no longer be able to control the magnitude of the delayed control signal. The time delay circuit 14 will then further increase the magnitude of the delayed control signal, as can be seen in FIG. 4. However, the driver stage is implemented in a manner such that it is not capable of responding to the increased delay control signal, as will be explained in greater detail below. Thus, feedback action is no longer provided and the output data differential signal will remain at zero volts.

The inductive load L of the isolation transformer is fully discharged and will not adversely impact receipt of the next data packet. Further, the magnitude of the undershoot/overshoot has been limited to the offset voltage produced by generator 40 and is independent of the duration of the high time period $t_{high}$.

Figure 5:
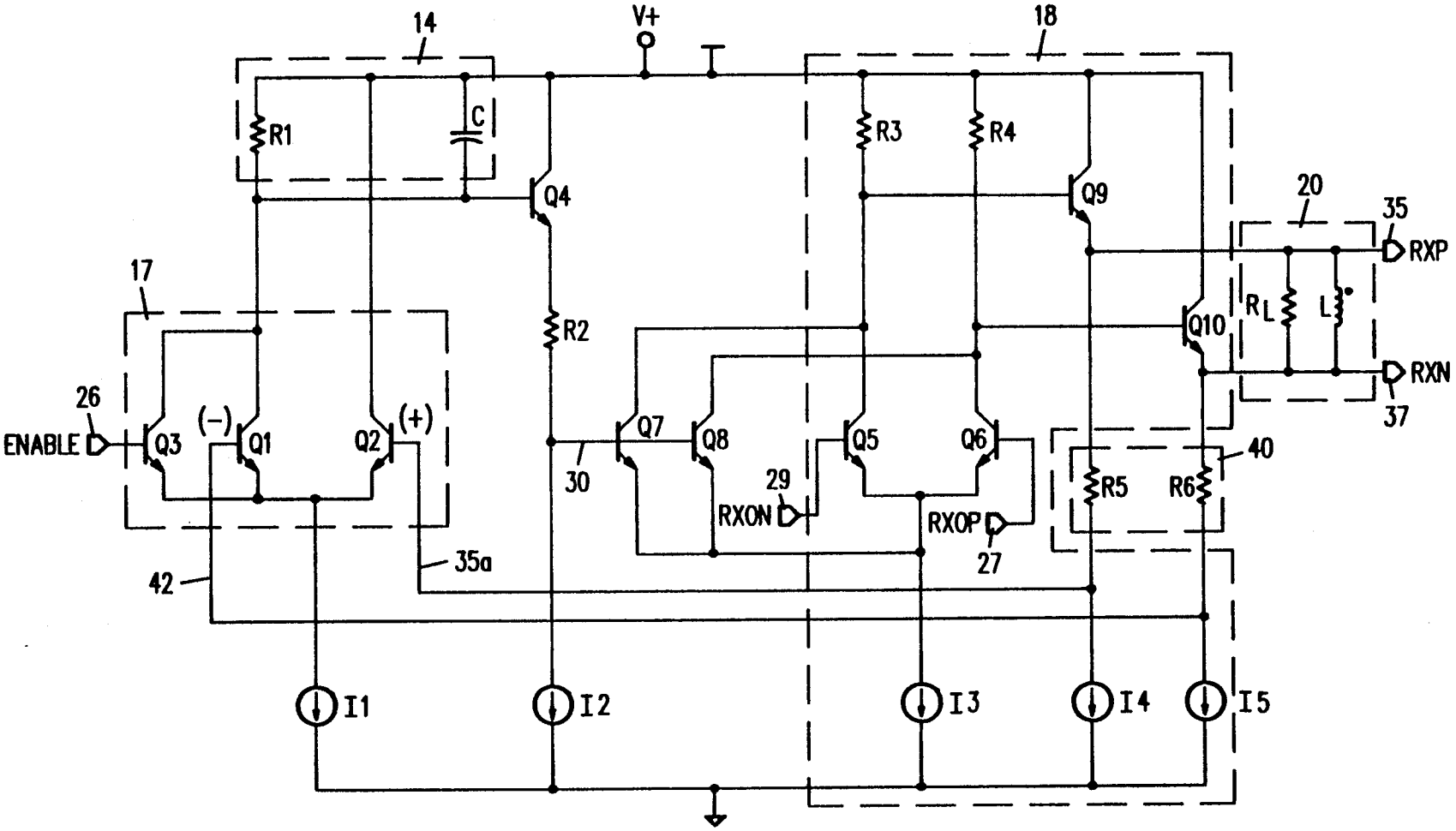
FIG. 5 is a schematic diagram of the first embodiment drive circuit.

FIG. 5 is a schematic diagram of the FIG. 3 first embodiment drive circuit. The output driver stage 18 includes a differential amplifier made up of transistors $Q_5$ and $Q_6$ and load resistors $R_3$ and $R_4$. The bases of transistors $Q_5$ and $Q_6$ are connected to lines 27 and 29 which carry the data input signals RXOP and RXON, respectively. Load resistors $R_3$ and $R_4$ of differential amplifier drive a pair of emitter followers which include transistors $Q_9$ and $Q_{10}$. The emitters of transistors $Q_9$ and $Q_{10}$ provide the output data signals RXP and RXN on lines 35 and 37, respectively.

Differential feedback signals are produced at resistors $R_5$ and $R_6$, each having a terminal connected to the respective differential outputs on lines 35 and 37. Resistor $R_5$ is connected to a current source $I_4$ which provides a level-shifting voltage. Similarly, resistor $R_6$ is connected to a current source $I_5$, equal to current source $I_4$, which provides a level-shifting voltage.

The offset voltage generator 40 is implemented by making resistor $R_6$ slightly larger than $R_5$ so that the voltage drop across $R_6$ is greater than that across $R_5$ by an amount equal to the desired offset voltage $V_{OS}$.

The error amplifier 17 includes a pair of transistors $Q_1$ and $Q_2$ having bases connected to lines 42 and 35*a*, respectively, which carry the levelshifted differential feedback signals The emitters of $Q_1$ and $Q_2$ are connected to a common current source $I_1$. The collector of $Q_1$ is connected to the positive power supply by way of a parallel connection of resistor $R_1$ and capacitor C which make up the time delay circuit 14. The collector of $Q_2$ is connected directly to the power supply.

Error amplifier 17 also includes a transistor $Q_3$ having an emitter and collector connected to the emitter and collector, respectively, of transistor Q1. The base of $Q_3$ is connected to line 26 which carries the enable signal.

The collectors of $Q_1$ and $Q_3$ are also connected to the base of an emitter follower-configured transistor $Q_4$. The collector of $Q_4$ is connected to the positive supply and the emitter is connected to the common bases of a pair of transistors $Q_7$ and $Q_8$ by way of a resistor $R_2$. A current source $I_2$ is connected between resistor $R_2$ and the circuit common to provide level shifting. Line 30 at the bases of transistors $Q_7$ and $Q_8$ carries the delayed control signal.

The collector and emitter of transistor $Q_7$ are connected in common with the collector and emitter, respectively, of transistor $Q_5$ of the output driver stage 18. Similarly, the collector and emitter of transistor $Q_8$ are connected in common with the collector and emitter, respectively, of transistor $Q_6$ of the output driver stage.

A brief description of the operation of the various components shown in FIG. 5 which comprise the first embodiment drive circuit will now be given with reference also to the FIG. 4 timing diagram. When a data packet is being received, the receive squelch causes the enable signal to go high as shown at point A of FIG. 4. This will cause transistor $Q_3$ to turn on and alter the charge on the timing capacitor C of the time delay circuit 14. This also causes the delayed control signal at line 30 to drop in magnitude. Since the collector of transistor $Q_1$ is pulled down by enable transistor $Q_3$, the error amplifier 17 is effectively overridden and cannot function.

The low delayed control signal at line 30 will hold transistors $Q_7$ and $Q_8$ off. Accordingly, the collectors of $Q_5$ and $Q_6$ are free to change and the output driver stage 18 is permitted to retransmit the received data packet as shown by the input data differential signal and the output data differential signal in FIG. 4.

At the end of the data packet, at point B, the enable signal is caused to go low by the receive squelch. In addition, the data inputs RXOP and RXON are both forced to their respective maximum states, with RXON held at a low level and RXOP held at a high level. Thus, the input data differential signal will be at a maximum positive value. At this point, the data output signal RXN will be at its maximum negative value and output RXP will be at its maximum positive value. Accordingly, the output data differential signal will also be at a maximum positive value. Thus, the feedback signal on line 42 will be at a low value and the feedback signal on line 35*a* will be at a high value. This is represented by the positive differential feedback signal of FIG. 4 which will cause transistors $Q_1$ and $Q_2$ of the error amplifier 17 to be off and on, respectively. In addition, transistor $Q_3$ will be turned off by the low enable signal.

Since the data input signal RXOP is held high and input signal RXON is held low, transistor $Q_6$ will be conductive and transistor $Q_5$ will be off. The magnitude of the delayed control signal will be relatively low, therefore, transistors $Q_7$ and $Q_8$ will also be off. Accordingly, all of the current sunk by current source $I_3$ will be provided by transistor $Q_6$. Thus, the collector of voltage of $Q_6$ will be at a minimum value and the collector of voltage of $Q_5$ will be at a maximum value.

Since transistors $Q_3$ and $Q_1$ of error amplifier 17 are both off, capacitor C will be free to discharge through resistor $R_1$. This will cause the delayed control signal on line 30 to slowly increase beginning at point B. This is the beginning of the high time period $t_{high}$.

Figure 4:
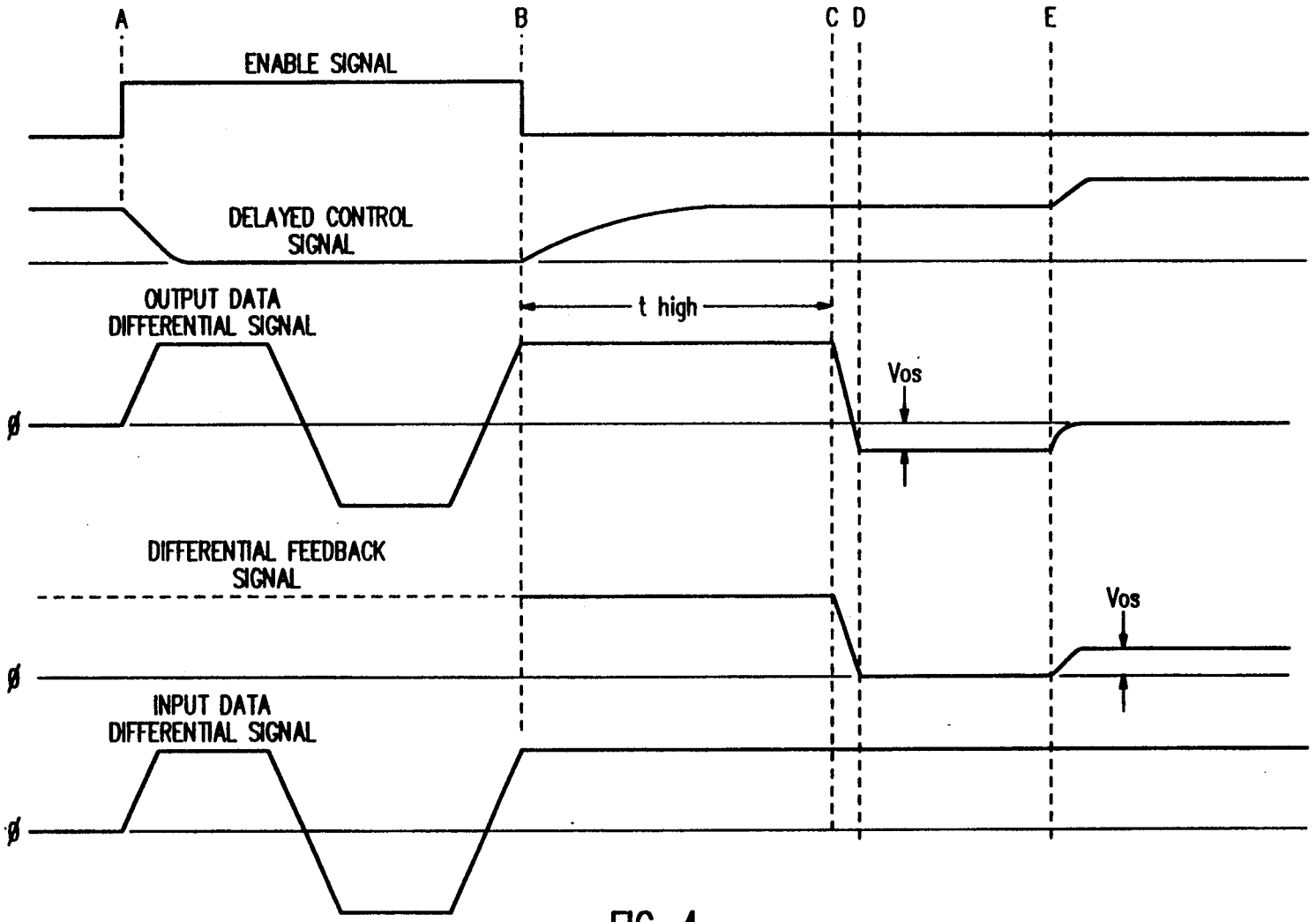
FIG. 4 depicts various waveforms illustrating the operation of the FIG. 3 drive circuit.

At point C of FIG. 4, the delayed control signal is of sufficient magnitude to start to turn on transistors $Q_7$ and $Q_8$. The delayed control signal is now at the previously noted threshold level. Transistors $Q_7$ and $Q_8$ will proceed to turn on and will conduct equal amounts of current. The total current flow through $Q_7$, $Q_8$, $Q_5$ and $Q_6$ will remain constant and will be equal to the current drawn by current source $I_3$. $Q_5$ is off because the data input signal RXON is forced low. Accordingly, the current flow through $Q_6$ will be reduced by an amount equal to that drawn by $Q_7$ and $Q_8$. The current flow drawn by $Q_7$ will cause the voltage at the collector of $Q_5$ to drop to a lower voltage level. This will cause the output data signal RXP to drop.

Although current through $Q_8$ will be provided by resistor $R_4$, the total current flow through $R_4$ will decrease. $Q_8$ will draw one unit of current from $R_4$, but the current flow through $Q_6$ will be reduced by two units since the total current flow to current source $I_3$ must remain constant. Thus, the net change will be a drop in current flow through resistor $R_4$ of one unit. The voltage at the collector of $Q_6$ will increase, thereby causing the data output signal RXN to increase in voltage. Thus, the increase in the delayed control signal on line 30 will begin to reduce the output data differential signal as shown in FIG. 4 at point C. This is the end of the high time period $t_{high}$.

During the period immediately following point C, where the output data differential signal approaches zero volts, the magnitude of the differential feedback signal will be positive. Thus, transistor $Q_1$ will remain fully off and transistor $Q_2$ will remain fully on. Accordingly, the error amplifier 17 is not in the linear active region and will not control the magnitude of the delayed control signal at line 30. Rather, the magnitude of the control signal will continue to be controlled by the RC network of the time delay circuit 14.

As the current flow through transistors $Q_7$ and $Q_8$ increases due to the increase in the magnitude of the delayed control signal, the current flow through transistors $Q_7$ and $Q_8$ will approach the value of the current source $I_3$. The current flow through transistor $Q_6$ will drop and the current flow through resistor $R_3$ will increase while the flow through resistor $R_4$ will decrease by an equal amount. Thus, the collector voltages of transistors $Q_5$ and $Q_6$ will approach equality.

Figure 6:
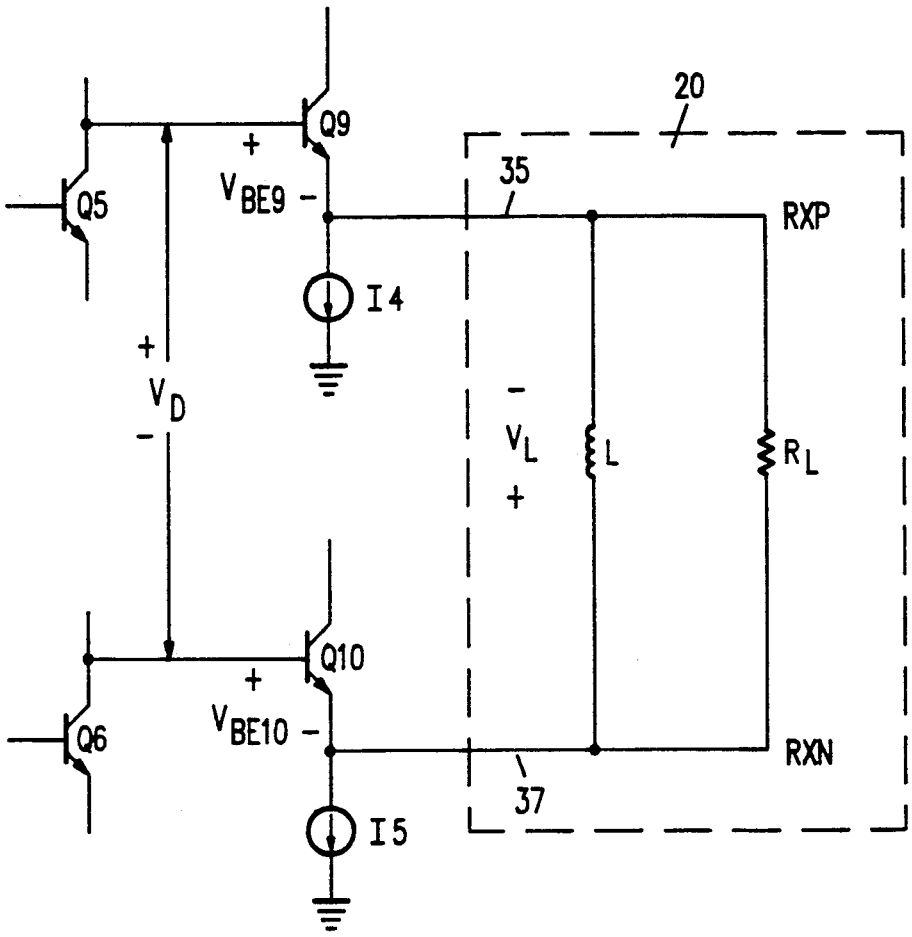
FIG. 6 is a schematic diagram of a portion of the output stage and associated load of the first embodiment drive circuit, with various voltages labeled.
Figure 7:
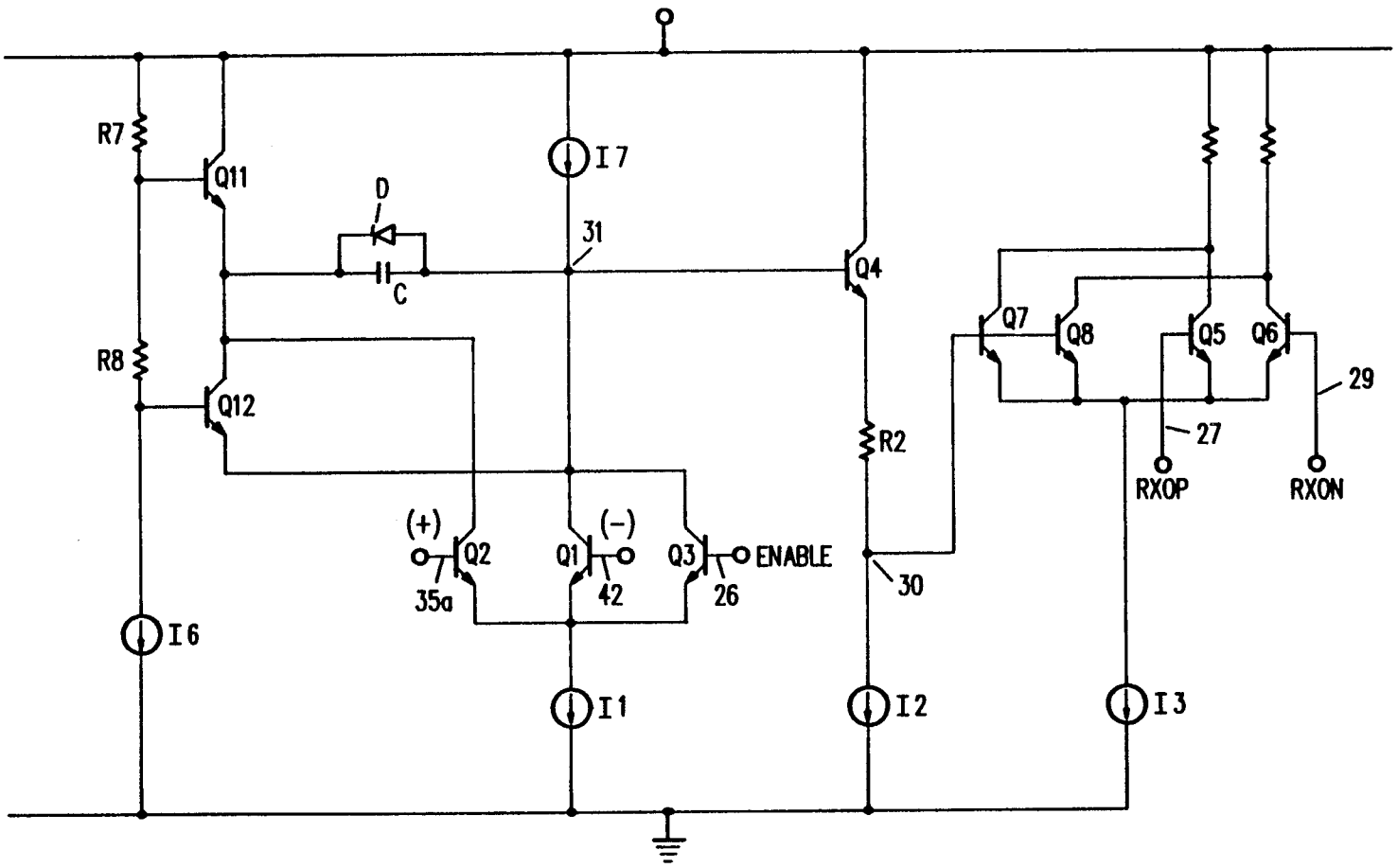
FIG. 7 is a schematic diagram of an improved error amplifier/time delay circuit for precisely controlling the duration of the high time period $t_{high}$.

FIG. 6 shows part of the FIG. 5 circuitry with various voltages labeled. The voltage difference between the collectors of transistors Q5 and $Q_6$ is labeled $V_D$ and the base-emitter voltages of transistors $Q_9$ and $Q_{10}$ are labeled $V_{BE9}$ and $V_{BE10}$, respectively. The output differential voltage is equal to self-induced EMF voltage of inductor L and is designated $V_L$. As voltage $V_D$ decreases in magnitude, the voltage across the inductor $V_L$, as shown in FIG. 6 will eventually reverse polarity. This occurs just prior to point D of FIG. 4. The inductor voltage $V_L$ will approach the offset voltage which time (point D of FIG. 4) the differential feedback signal will be at zero volts. Accordingly, the inputs to error amplifier 17 will be equal. Transistor $Q_1$ of the error amplifier 17 will become active and will limit any further increase in the base voltage of transistor $Q_4$. Thus, the error amplifier 17 will proceed to control the magnitude of the delayed control signal through feedback action. In addition to providing a time delay, resistor $R_L$ and capacitor C function to frequency compensate the feedback loop.

Typical voltage values may be helpful in explaining the operation of the subject drive circuit when feedback action commences. The voltages shown in FIG. 6 vary in accordance with the following equation:

$$V_D = V_{BE9} - V_L - V_{BE10} \quad (1)$$

Assume, by way of example, that the offset voltage $V_{OS}$ produced by generator 40 is 60 millivolts and the base-emitter voltage $V_{BE9}$ is nominally 700 millivolts when transistor $Q_9$ is fully conductive. Further assume that the collector voltage of $Q_5$ has almost approached the collector voltage of $Q_6$ so that $V_D$ is 50 millivolts. When the inductor voltage $V_L$, the output differential voltage, is equal to the offset voltage of 60 millivolts, equation (1) indicates that the base-emitter voltage $V_{BE10}$ will be only 590 millivolts in comparison to the nominal 700 millivolts when the transistor is fully conductive.

Since the base-emitter voltage $V_{BE10}$ is substantially less than the base-emitter voltage when the transistor is fully conductive, transistor $Q_{10}$ will be only slightly conductive. Stated differently, the self induced EMF voltage $V_L$ will raise the emitter voltage of $Q_{10}$, thereby causing transistor $Q_{10}$ to turn off to a large extent. Current drawn by current source $I_5$ will then be provided by inductor L rather than transistor $Q_{10}$. Any further tendency of voltage $V_L$ to exceed the offset voltage $V_{OS}$ produced by generator 40 will result in a slight decrease in the delayed control signal because of feedback. The slight decrease will increase the voltage $V_D$ which will cause transistor $Q_{10}$ to become even less conductive. This will cause additional current from source $I_5$ to become available to discharge inductor L and maintain the output differential voltage at the desired offset level $V_{OS}$.

The differential output voltage will be held at a negative offset voltage $V_{OS}$ until inductor L has completely discharged. At point E (FIG. 4), the inductor is substantially discharged and effectively becomes a D.C. short circuit. At this point transistors $Q_7$ and $Q_8$ will cause equal amounts of current to flow through resistors $R_3$ and $R_4$ so that the differential voltage $V_D$ (FIG. 6) will be zero volts.

The change in the differential output voltage toward zero volts will cause the differential feedback signal to approach the offset voltage $V_{OS}$. This action will cause transistor $Q_1$ of the error amplifier 17 to turn off. Capacitor C will resume discharging, causing the delayed control signal to increase in magnitude. This will cause transistors $Q_7$ and $Q_8$ to turn on an additional amount so that the two transistors are conducting all of the current supplied to current source $I_3$.

It can be seen that it is not possible for the differential voltage $V_D$ to change polarity, because of the manner in which the driver stage is implemented. Accordingly, the feedback loop is not capable of forcing the output data differential signal to be equal to the offset voltage $V_{OS}$. Feedback action no longer occurs. At this point, the effective inductance L of the isolation transformer has been fully discharged.

Because the feedback loop does not attempt to force the voltage of the output data differential signal to equal the offset voltage $V_{OS}$, the subject drive circuit does not introduce currents into the transformer primary which would adversely affect the capability of the transformer to handle the next data packet. As previously noted, prior art drive circuits utilizing continuously active feedback circuits will have a tendency to compensate for any offset inherent in the feedback loop by constantly attempting to slightly adjust the voltage across the transformer primary. Even very small changes in voltage across the transformer will tend to introduce undesired current flow through the transformer.

The magnitude of the offset voltage $V_{OS}$ should be selected to be equal to or less than the maximum specified undershoot/overshoot. The larger the value of $V_{OS}$, the more quickly the inductor L will discharge. At minimum, the value of $V_{OS}$ should exceed the maximum value of any inherent offset in the feedback network so as to ensure that feedback action will terminate once the voltage of the inductor has reached substantially zero volts when the inductor is fully discharged.

As previously noted, the high time period $t_{high}$ must typically comply with a specification which sets the minimum and maximum duration of the period. Although it is desireable to minimize the high time period $t_{high}$, the period is not always well controlled, particularly if the drive circuit is implemented in monolithic integrated circuit form. By way of example, due to process variations and the like, the time period $t_{high}$ provided by the time delay circuit 14 and the error amplifier 17 may vary by ±50%. Accordingly, drive circuits are typically designed to have a nominal high time period $t_{high}$ substantially in excess of the specified minimum period to insure that the specified minimum period is met under worst case conditions.

Figure 8:
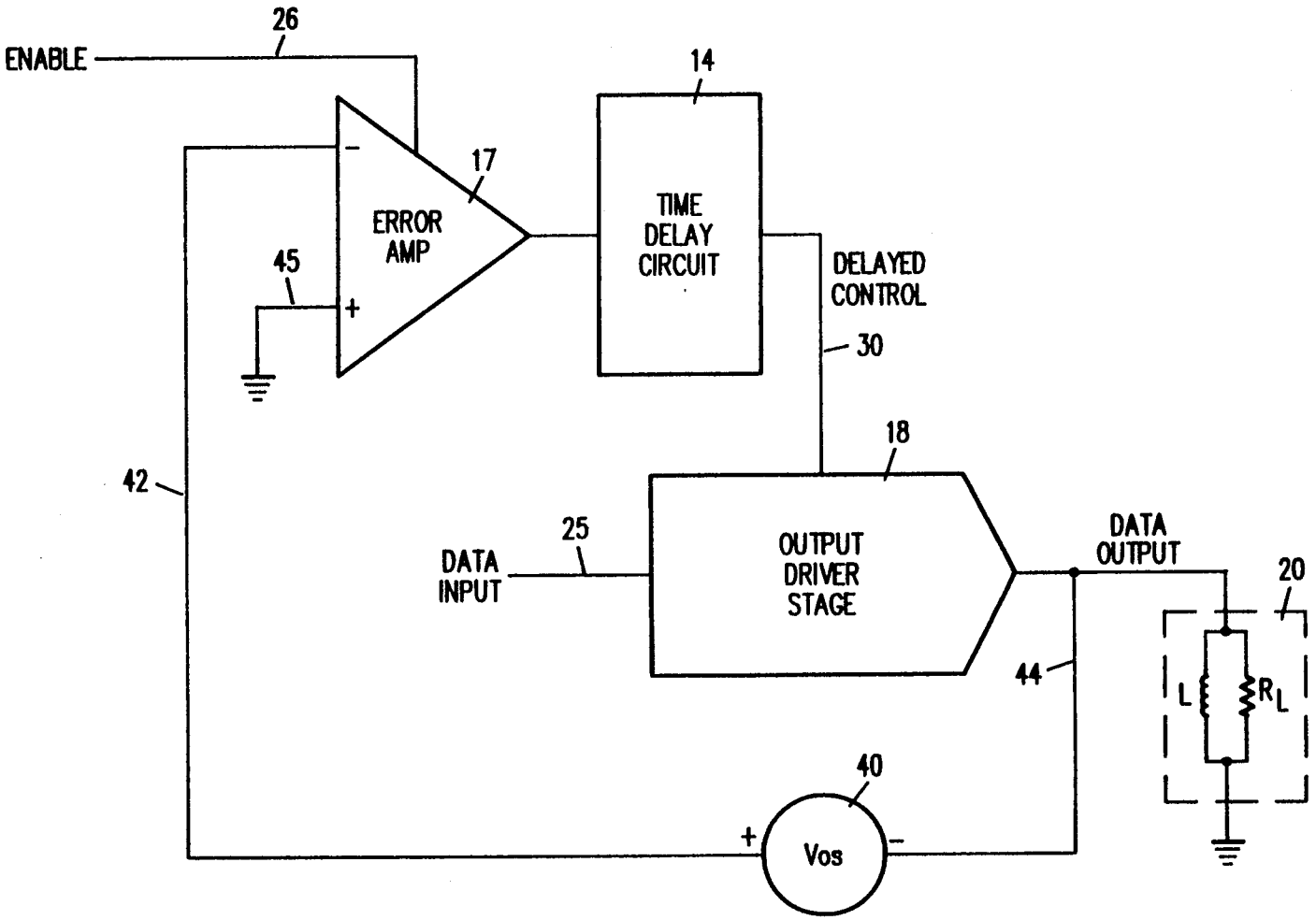
FIG. 8 is a block diagram of a second embodiment drive circuit having a single-ended data input and a single-ended data output.

FIG. 8 shows an alternative error amplifier/time delay circuit which provides a more precise high time period $t_{high}$. Accordingly the nominal period can be set closer to the minimum specified, as desired.

The alternative error amplifier/time delay circuit includes transistors $Q_1$ and $Q_2$ having common emitters connected to a current source $I_1$, with the bases of the two transistors connected to feedback lines 42 and 35*a*. The collector of transistor $Q_1$ is connected to a node 31.

Node 31 is connected to the base of transistor $Q_4$, one terminal of a timing capacitor C and to the output of a current source $I_7$. The collector of transistor $Q_2$ is connected to the other terminal of capacitor C and to the emitter and collector of transistors $Q_{11}$ and $Q_{12}$, respectively. A Schottky diode D is connected in parallel with capacitor C.

Biasing voltages are provided by the combination of resistors $R_7$ and $R_8$ and a current source $I_6$ connected in series between the positive supply and ground. The base of transistor $Q_{12}$ is connected between resistor $R_8$ and the current source and the base of transistor $Q_{11}$ is connected between resistors $R_7$ and $R_8$.

In operation, with reference also being made to the timing diagram of FIG. 4, the base voltages of transistors $Q_{11}$ and $Q_{12}$ are fixed with respect to the power supply. The electrode of capacitor C is connected to the emitter of transistor $Q_{11}$ and is clamped by the forward biased base-emitter junction of transistor $Q_{11}$.

When the enable signal on line 26 goes high (point A), transistor $Q_3$ is turned on thereby discharging capacitor C. The free capacitor C electrode connected to node 31 will be pulled down until the base-emitter junction of transistor $Q_{12}$ is forward biased so as to clamp the voltage at the node.

When the enable signal goes low (point B), transistor $Q_3$ is turned off. At this point, transistor $Q_1$ of the error amplifier will also be off because of the polarity of the feedback signals on lines 35*a* and 42. This is the beginning of the high time period $t_{high}$.

Once transistor $Q_1$ is off, capacitor C will become charged by current source $I_7$. This will cause the voltage at node 31 to linearly increase. The voltage at node 31 will increase until the delayed control signal at node 30 reaches the threshold voltage (point C). This is the end of the high time period $t_{high}$.

At the threshold voltage, transistor $Q_4$ will cause transistors $Q_7$ and $Q_8$ to turn on, thereby causing the outputs of the drive circuit to approach the mid-level point. Eventually, feedback will cause transistor $Q_1$ of the error amplifier to turn on thereby preventing the voltage at nodes 30 and 31 from increasing further (point D).

Once the inductor has been substantially discharged (point E), the feedback signal will again become positive causing transistor $Q_1$ to turn back off. Current source $I_7$ will then proceed to continue charging capacitor C until the voltage at node 31 exceeds the emitter voltage of Q:: by approximately 500 millivolts. At that point, Schottky diode D will become forward biased, thereby clamping the voltage.

The duration of the high time period $t_{high}$ is as follows:

$$t_{high} = \frac{C\Delta V}{I_7} \quad (2)$$

where

C is the capacitance of capacitor C;

ΔV is the magnitude of the voltage swing of node 31; and $I_7$ is the magnitude of the current source $I_7$.

Current sources $I_2$ and $I_6$ provide current developed by an internal (to the integrated circuit) reference voltage $V_{REF}$ (not depicted) and an internal resistor $R_{INT}$ (not depicted). Current source $I_7$ provides current developed by the internal reference voltage $V_{REF}$ and a precision external resistor $R_{EXT}$ (not depicted). The voltage $V_1$ at the beginning of the ΔV voltage swing is equal to the supply voltage minus the sum of the voltage drops across internal resistors $R_7$, $R_8$ and the base-emitter voltage of transistor $Q_{12}$. Accordingly, voltage $V_2$ is proportional to the reference voltage $V_{REF}$ and the internal resistances as follows:

$$V_1 \alpha (R_7 + R_8) I_6 \quad (3)$$

or $$V_1 \alpha (R_7 + R_8)\left(\frac{V_{REF}}{R_{INT}}\right) \quad (4)$$

Since resistors $R_7$, $R_8$ and $R_{INT}$ track one another, voltage $V_1$ will be proportional to the reference voltage $V_{REF}$ as follows:

$$V \alpha V_{REF} \quad (5)$$

The voltage $V_2$ at the end of the ΔV voltage swing is the voltage at node 31 when the delayed control signal at line 30 reaches the threshold voltage. At this point, the voltage at the bases of transistor $Q_7$ and $Q_8$ will be equal to the high data input $R_{XOP}$ applied to the base of transistor $Q_6$ which is forced high at this time. The voltage $V_2$ at node 31 will be equal to the threshold voltage at node 30 plus the voltage drop across $R_2$ and the base-emitter junction of transistor $Q_4$. Accordingly, voltage $V_1$ will be approximately proportional to the external reference voltage $V_{REF}$ and internal resistor $R_2$ as follows:

$$V_2 \alpha R_2 I_2 \quad (6)$$

or $$V_2 \alpha \frac{R_2 V_{REF}}{R_{INT}} \quad (7)$$

Since resistor $R_2$ and $R_{INT}$ will track one another, voltage $V_2$ is proportional to the reference voltage as follows:

$$V_2 \alpha V_{REF} \quad (8)$$

It can be seen from equations (2), (5) and (6) that the high time period $t_{high}$ is proportional to the external resistor $R_{EXT}$ and the capacitor C as follows:

$$t_{high} = \frac{C\,k\,V_{REF}}{\frac{V_{REF}}{R_{EXT}}} \quad (9)$$

where k is a proportionality constant. or $$t_{high} = k\,R_{EXT}\,C \quad (10)$$

Figure 1:
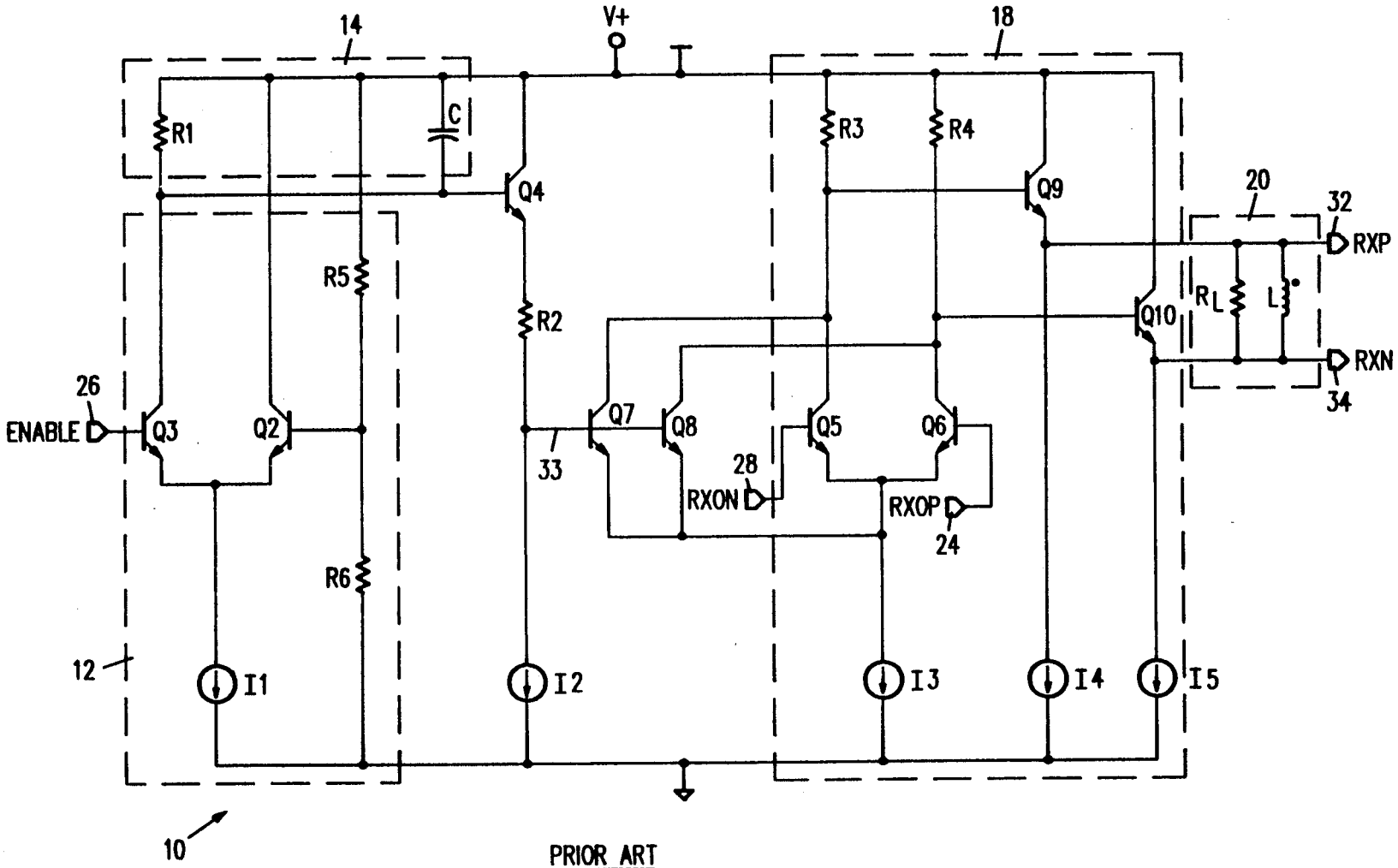
PRIOR ART FIG. 1
FIG. 1 is a circuit diagram of a conventional drive circuit used for driving an inductive load, such as the primary winding of an isolation transformer.
Figure 2:
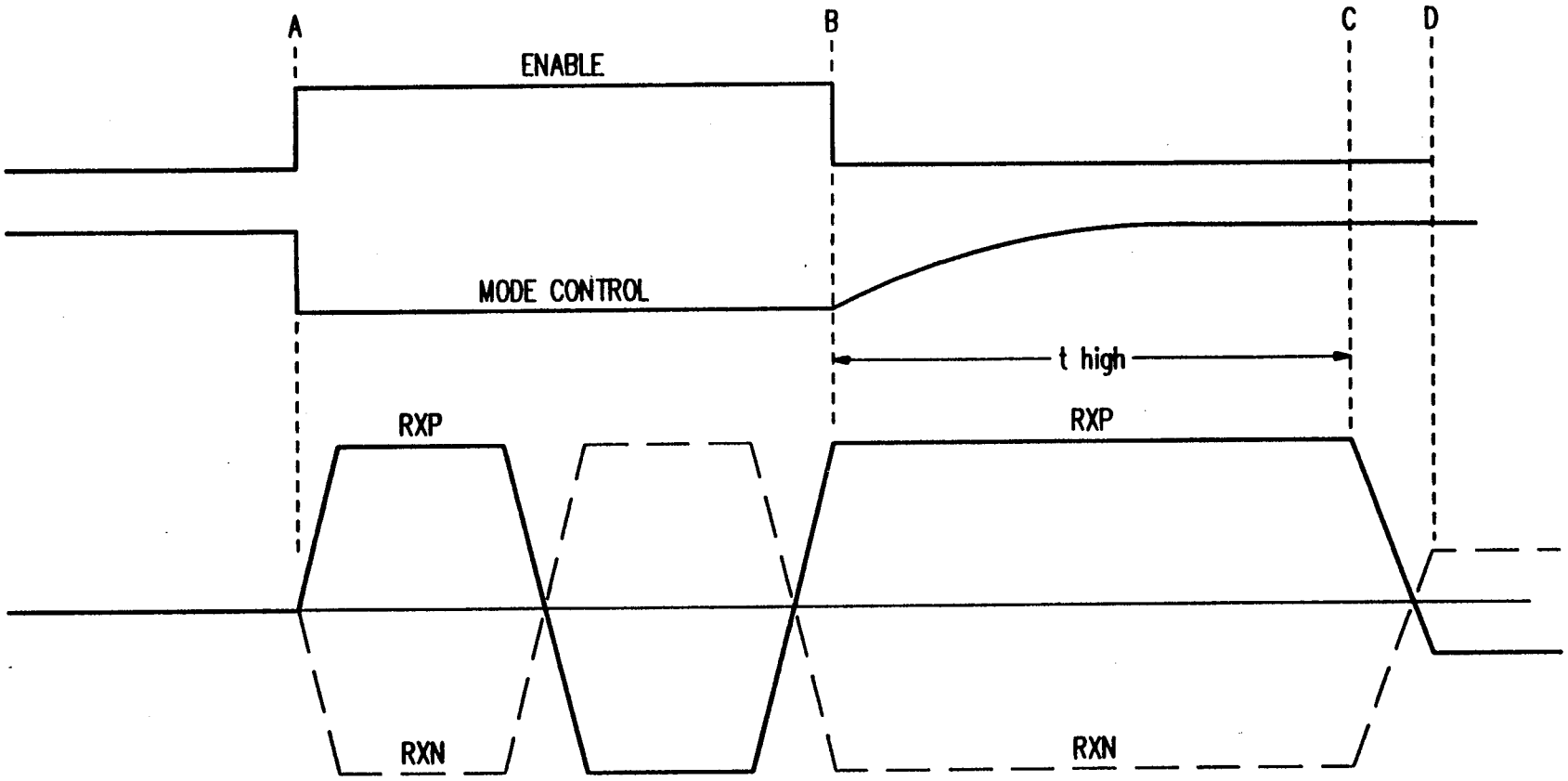
PRIOR ART FIG. 2
FIG. 2 depicts various waveforms which illustrate the operation of the conventional FIG. 1 drive circuit.

Thus, the high time period $t_{high}$ will vary with the capacitor C and the external precision resistor $R_{EXT}$ only. The period will not be substantially affected by variations in the values of the internal resistors. The variations in period $t_{high}$ are held to ±15% as compared to ±50% for conventional time delay circuits as shown in FIG. 1.

Referring to the block diagram of FIG. 8, a second embodiment of the invention is disclosed. This embodiment is a single-ended drive circuit, as opposed to the first embodiment differential circuit. The second embodiment is powered to positive and negative supply voltages.

The drive circuit includes an output driver stage 18 which receives the data packets or other form of input data on line 25 and retransmits the data packet to the output on line 44. Line 44 is coupled to a load 20 which represents the primary of an isolation transformer together with a parallel resistor $R_L$. The effective inductance of the transformer is represented by inductor L.

The second embodiment drive circuit includes an error amplifier !7 which is controlled by an enable signal on line 26. One input of the amplifier, the non-inverting input, is connected to ground and the second input (the inverting input) is connected to the data output line 44 by way of an offset voltage generator 40.

The output of amplifier 17 controls a time delay circuit 14 which produces a delayed control signal on line 30. The delayed control signal functions to force the output of the output driver stage 18 to ground depending upon the level of the signal.

The enable signal is present (high) when data are being received on line 25 by the output driver stage 18. The high enable signal will override the operation of the error amplifier 17 so that the level of the feedback signal on line 42 will be ignored. Under these conditions, with the enable signal high, the error amplifier 17 and the time delay circuit 14 will not interfere with the transmission of data through the output driver stage 18.

When the data packet transmission is completed, the data input of line 25 goes to a fixed high value. In addition, the enable signal on line 26 is caused to go low thereby removing the error amplifier 17 override. Accordingly, amplifier 17 becomes operational, but does not yet control the operation of the driver stage 18.

The low enable signal will also cause the error amplifier to actuate the time delay circuit 14 which will, in turn, cause the delayed control signal at line 30 to start to rise. This is the beginning of the high time period $t_{high}$. The increase in the delayed control signal voltage will be controlled by an RC network in circuit 14. At this point, the data output on line 44 of the output driver stage is at a high voltage which is greatly in excess of the offset voltage $V_{OS}$ produced by generator 40. Accordingly, the voltage on line 42 applied to the inverting input of amplifier 17 will exceed zero volts.

The delayed control signal at line 30 will eventually reach a threshold voltage. At that time, the output drive stage will respond to the control signal and the output of the stage will proceed to be shut down. This action will cause the output voltage on line 44 to drop as the inductor proceeds to discharge. This is the end of the high time period $t_{high}$.

Eventually, the output voltage across inductor L will drop to zero volts and then will undershoot zero volts by going negative. Once the magnitude of the undershoot is equal to the offset voltage provided by generator 40, the input voltage to the inverting input of amplifier 17 will be at zero volts and the amplifier will become linear. Amplifier 17 will respond by preventing the control voltage from increasing further.

By way of feedback action, the magnitude of the control voltage at line 30 will be maintained at a level sufficient to maintain the output voltage on line 44 at a negative value equal to the offset voltage $V_{OS}$. During this period, the inductor will discharge.

Once the discharge has been completed, the inductor L will become a D.C. short circuit and will force the output on line 44 to zero volts. The feedback voltage on line 42 will go positive by $V_{OS}$. This action will prevent the error amplifier from further controlling the output of the output driver stage. Eventually, the output of the stage will be forced to zero volts by the inductor, thereby ending the sequence.

Thus, two embodiments of a novel drive circuit have been disclosed along with a time delay circuit/error amplifier. Although the invention has been described in some detail, it is to be understood that variations changes can be made by those skilled in the art without departing from the spirit and scope of the invention as defined by the appended claims.

We claim:

1. A drive circuit for driving an inductive load, including:

driver stage means having at least one output for coupling to the inductive load and which is switchable between a drive mode and an idle mode, with said driver stage means receiving a data input signal and producing a data output signal at the output which is responsive to the data input signal when the driver stage means is switched to the drive mode and with the driver stage means producing an idle output signal at the output which is responsive to a control signal when the driver stage means is switched to the idle mode; and feedback means for generating the control signal in response to the idle output signal and for adjusting the control signal so as to cause the idle output signal to approach a predetermined neutral level by way of feedback action and for terminating the feedback action while the driver stage means is in the idle mode but after the idle output signal has reached the neutral level;

whereby the data output signal will be forwarded to the inductive load during the drive mode and the inductor will be at least partially discharged to the neutral level during the idle mode.

2. The drive circuit of claim 1 wherein said feedback means includes:

error amplifier means for comparing the idle output signal with a reference signal and adjusting the control signal in response thereto.

3. The drive circuit of claim 2 further including enable means for causing the driver stage means to switch between the drive mode and the idle mode response to an enable signal.

4. The drive circuit of claim 3 wherein said enable means is also a means for preventing the control signal from effecting the data output signal when the driver stage means is in the drive mode.

5. The drive circuit of claim 4 further including time delay means for providing a delay which prevents the feedback means from causing the idle signal to approach the neutral level for a predetermined time period after the enable means has caused the driver stage means to switch to the idle mode.

6. The drive circuit of claim 5 wherein the predetermined time period is controlled by an RC network.

7. The drive circuit of claim 6 wherein the RC network is set to a first charge state when the driver stage means is in the drive mode and wherein the RC network changes to a second charge state after the predetermined time period.

8. The drive circuit of claim 7 wherein the driver stage means responds to the magnitude of the control signal and wherein the time delay means provides tne time delay by controlling the magnitude of the control signal.

9. The driver circuit of claim 5 wherein the predetermined time period is controlled by a capacitor charged by a current source.

10. The driver circuit of claim 9 wherein the capacitor has one terminal maintained at a relatively fixed voltage and a second terminal which is coupled to the current source.

11. The drive circuit of claim 10 wherein the predetermined time period is determined by the amount of time required for the current source to change the voltage at the second terminal of the capacitor from a first voltage to a second voltage, with the magnitude of the difference between the first and second voltage being proportional to the duration of the predetermined time period.

12. The drive circuit of claim 11 wherein at least a portion of the drive circuit is implemented as a monolithic integrated circuit, with the delay circuit means including a plurality of monolithic resistors, and with the magnitude of the difference voltage being substantially independent of any variations in the absolute values of the monolithic resistors due to integrated circuit manufacturing processes.

13. A drive circuit of claim 1 wherein the data input signal is a differential signal, the at least one output is a pair of outputs and the data output signal is a differential data output signal responsive to the differential input signal when the driver stage is the drive mode and the idle output signal is a differential idle output signal which is at a maximum value at the beginning of the idle period and which approaches the predetermined neutral level by way of the feedback action.

14. The drive circuit of claim 13 wherein the feedback means includes voltage offset means for generating an offset voltage such that the predetermined neutral level is equal to the magnitude of the offset voltage and has a polarity which is opposite that of the differential idle output signal at the beginning of the idle period.

15. The drive circuit of claim 14 wherein the feedback means terminates the feedback action when the differential idle output signal changes from the predetermined neutral level to a substantially zero volt level, with the change occurring as a result of an inductor coupled to the driver stage outputs becoming substantially fully discharged.

16. A drive circuit capable of discharging an inductive load, the drive circuit including:

driver stage means having at least one output for coupling to the inductive load and for producing an idle output signal at the output which is responsive to a control signal; and feedback means for generating the control signal in response to the idle output signal and for adjusting the control signal so as to cause the idle output signal to change from a first polarity to a second polarity opposite the first polarity and to maintain the idle signal at the second polarity by way of feedback action until the inductor is substantially discharged and to discontinue the feedback action when the substantially discharged inductor causes the idle signal to drop to zero volts.

17. The drive circuit of claim 16 wherein the driver stage means is switchable between a drive mode and an idle mode, with the driver stage means receiving a data input signal and producing a data output signal at the output which is responsive to the data input signal when the driver stage means is switched to the drive mode and with the driver stage means producing the idle output signal when the driver stage means is switched to the idle mode.

18. A method of discharging an inductive load with a minimum of undershoot/overshoot comprising the following steps:

applying a voltage across the inductive load having a first polarity;

changing the voltage until the voltage is at a second polarity opposite the first polarity;

sensing when the second polarity voltage has reached a predetermined offset voltage, with the magnitude of the offset voltage being determined by the maximum desired undershoot/overshoot;

maintaining the second polarity offset voltage by way of feedback action until the inductive load is substantially discharged; and discontinuing further control of the offset voltage once the voltage begins to shift in a direction of the first polarity as a result of the inductor becoming substantially discharged.

* * * * *